US010058762B2

(12) United States Patent
Freeman

(10) Patent No.: US 10,058,762 B2
(45) Date of Patent: Aug. 28, 2018

(54) HAND-HELD BASEBALL UMPIRE'S COUNT INDICATOR

(71) Applicant: Trevor J Freeman, Huntington Beach, CA (US)

(72) Inventor: Trevor J Freeman, Huntington Beach, CA (US)

( * ) Notice: Subject to any disclaimer, the term of this patent is extended or adjusted under 35 U.S.C. 154(b) by 0 days.

(21) Appl. No.: 15/461,190

(22) Filed: Mar. 16, 2017

(65) Prior Publication Data

US 2018/0015352 A1 Jan. 18, 2018

Related U.S. Application Data

(60) Provisional application No. 62/361,956, filed on Jul. 13, 2016.

(51) Int. Cl.
*A63B 71/06* (2006.01)

(52) U.S. Cl.
CPC ..... *A63B 71/06* (2013.01)

(58) Field of Classification Search
CPC ..... A63B 71/06
See application file for complete search history.

(56) References Cited

U.S. PATENT DOCUMENTS 1,447,717 A * 3/1923 Grady ..... A63F 5/04 273/141 R
1,964,211 A * 6/1934 Overbury ..... G06C 15/00 235/63 H
2,060,431 A * 11/1936 Spicer ..... G09F 9/40 200/16 E
3,446,433 A * 5/1969 Tibbetts ..... G06C 7/06 235/145 R
3,556,398 A * 1/1971 Walsh ..... G06C 1/00 235/110
3,705,722 A * 12/1972 Bolger, Jr. ..... A63D 5/04 235/419
4,072,125 A 2/1978 Spalla
5,084,695 A 1/1992 Freeman
5,181,009 A * 1/1993 Perona ..... G04B 37/12 273/DIG. 26
D419,460 S * 1/2000 Mann ..... D10/46.1
D546,209 S 7/2007 Kelley
7,967,188 B2 6/2011 Hickox
(Continued)

FOREIGN PATENT DOCUMENTS

CA 2 466 840 10/2004

*Primary Examiner* — Christopher Stanford
(74) *Attorney, Agent, or Firm* — Morland C. Fischer

(57) ABSTRACT

Disclosed herein is a hand-held count indicator of the kind having particular application to be used by a baseball umpire. The count indicator includes rows of indicator pins which are representative of balls, strikes and outs called by the umpire. A pushing force applied by the umpire to selected ones of the indicator pins causes the pins to slide through the count indicator from a raised position extending outwardly from the top of the device to a depressed position extending outwardly from the bottom of the device. The tops of the indicator pins have different shapes that can be tactilely sensed and distinguished from one another to provide the umpire with an indication of strikes, balls and outs at any time during play without the umpire having to shift his eyes away from the game in order to look at the count indicator.

20 Claims, 13 Drawing Sheets

(56) References Cited

U.S. PATENT DOCUMENTS

| | | | | |
|---|---|---|---|---|
| 2007/0030128 | A1 | 2/2007 | Hills et al. | |
| 2008/0101840 | A1* | 5/2008 | Chaumont | G06F 1/1613 400/490 |
| 2009/0138907 | A1* | 5/2009 | Wiser | H04N 5/4403 725/34 |
| 2012/0255482 | A1 | 10/2012 | Terenzoni | |

* cited by examiner

HAND-HELD BASEBALL UMPIRE'S COUNT INDICATOR

CROSS-REFERENCE TO RELATED APPLICATIONS

1. This application is related to Provisional Patent Application No. 62/361,956 filed Jul. 13, 2016.

BACKGROUND OF THE INVENTION

1. Field of the Invention

This invention relates to a device to be used by those (e.g., umpires) engaged in a game of sports (e.g., baseball) during which parameters associated with the game (e.g., balls, strikes and outs) are indicated and tracked. The count indicator herein disclosed has rows of tactilely distinguishable indicator pins which are moved through the device and easily recognized by the umpire using only his sense of touch and without having to take his eyes off the game being played.

2. Background Art

Hand-held count indicators have long been used by umpires involved in the game of baseball. Some conventional count indicators have a plurality of counting wheels which are manually manipulated by the umpire to count and keep track of strikes, balls, outs and other parameters commonly associated with the game of baseball. Should the umpire wish to check the status of play at any particular time, he typically takes his eyes off the game and focuses his attention on the count indicator so as to visualize the positions of the counting wheels. Thus, the umpire may repeatedly lose his concentration while shifting his eyes and attention from the game to the count indicator. In this case, it is possible that the umpire can miss some of the play or forget his thoughts about the game.

It would be desirable to overcome the aforementioned disadvantages with conventional hand-held count indicators by means of an improved hand-held count indicator to be used primarily by a baseball umpire by which he can keep track of and be provided with ready access to parameters associated with the game of baseball with the umpire using his sense of touch only and without having to take his eyes off the game to focus on the device.

SUMMARY OF THE INVENTION

In general terms, a hand-held count indicator is disclosed having particular application to be used by a baseball umpire during the game of baseball. The hand-held count indicator herein disclosed advantageously provides the umpire with a tactile indication of balls, strikes and outs at any time during play. That is to say, the count indicator can be "read" by the umpire by using his sense of touch only. By virtue of the foregoing, the umpire can at all times keep track and remain aware of balls, strikes and outs without having to take his eyes off the game to look at the count indicator as is otherwise required with many conventional hand-held count indicators.

The hand-held count indicator includes first, second and third rows of indicator pins which correspond to and are indicative of balls, strikes and outs at any time during play. The indicator pins from the first, second and third rows thereof have different shapes which are tactilely distinguishable from one another. By way of example only, each pin from the first row of indicator pins indicative of balls has a cylindrical body and a domed top, each pin from the second row of indicator pins indicative of a strike has a rectangular body and a pointed top, and each pin from the third row of indicator pins indicative of an out has a rectangular body and a flat top. Each indicator pin also has a stop projecting from one side and upper and lower locking detents located at the opposite side. The indicator pins are slidable downwardly through indicator pin receiving holes formed in the count indicator from an upstanding raised position to a depressed position in response to a pushing force applied thereto by the umpire.

Depending upon whether a strike, a ball or an out is to be recorded on the hand-held count indicator, a particular indicator pin from one of the first, second and third rows of indicator pins is selected and pushed by the umpire from its raised position to its depressed position. The stop projecting from one side of the selected indicator pin rides to the end of a guide channel to limit the downward movement of and prevent the indicator pin from being pushed completely out of the count indicator. According to a first preferred embodiment, as the selected indicator pin slides downwardly through the count indicator, a locking ball that is carried by a flexible locking finger is removed from the upper locking detent at the opposite side of the pin and received in locking engagement by the lower locking detent so as to hold the indicator pin in place in its depressed position. According to a second preferred embodiment, a locking ball that is slidable through a spring-actuated ball nose plunger is removed from the upper locking detent for receipt by the lower locking detent so as to hold the indicator pin in place. Without having to look at the count indicator, the umpire can use his finger tip or tips to feel the top of the indicator pin and, depending upon its raised or recessed position, receive a tactile indication of the ball, strike or out being indicated thereby.

DESCRIPTION OF THE PREFERRED EMBODIMENT

Figure 1:
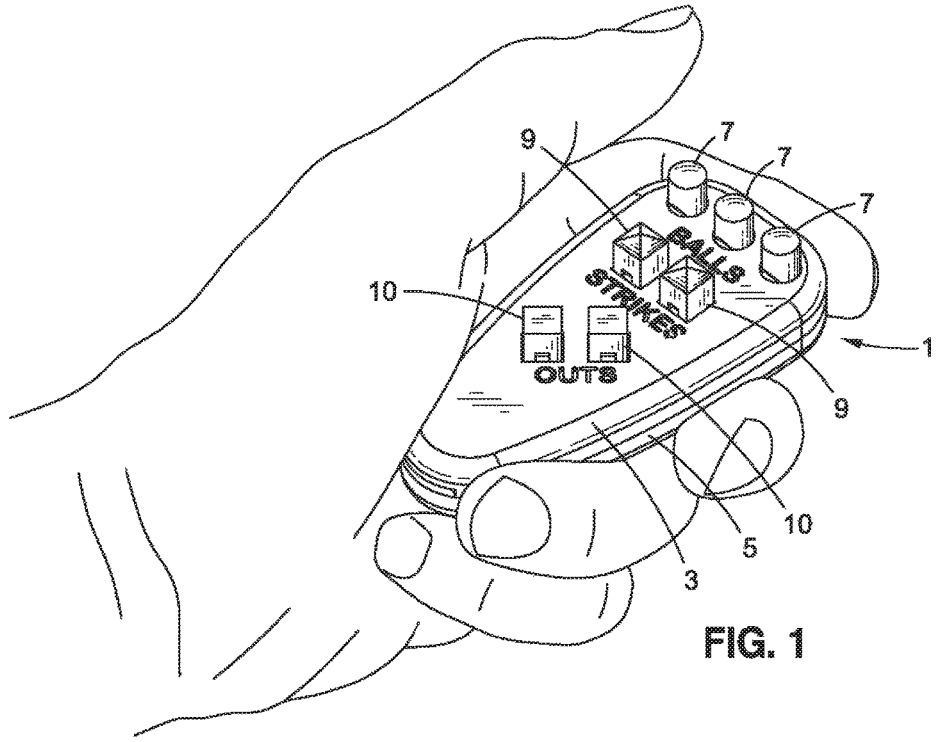
FIG. 1 shows the hand-held count indicator according to a first preferred embodiment of this invention being held in the hand of an umpire with first, second and third rows of indicator pins standing upwardly from the device in a raised position at the start of an inning during the game of baseball.
Figure 2:
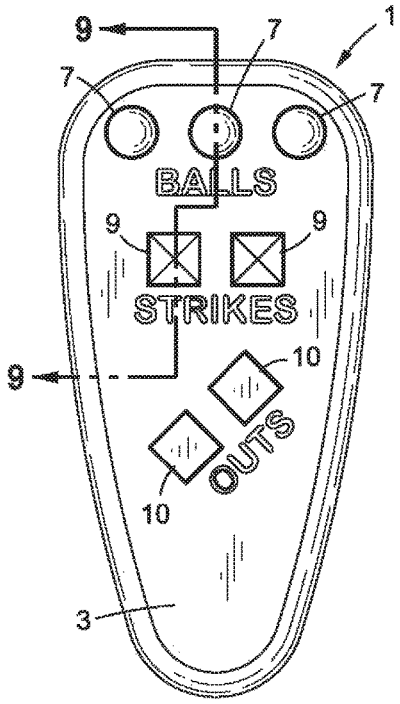
FIG. 2 is a top view of the hand-held count indicator shown in FIG. 1.
Figure 3:
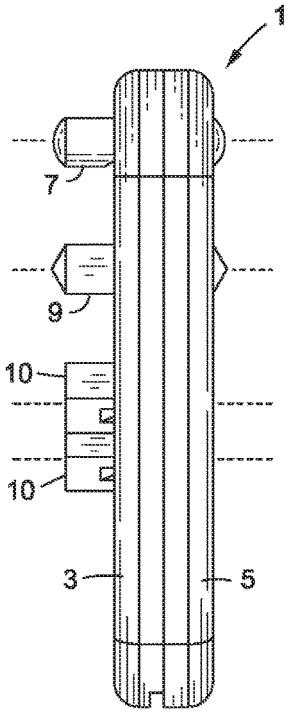
FIG. 3 is a side view of the hand-held count indicator shown in FIG. 1.
Figure 4:
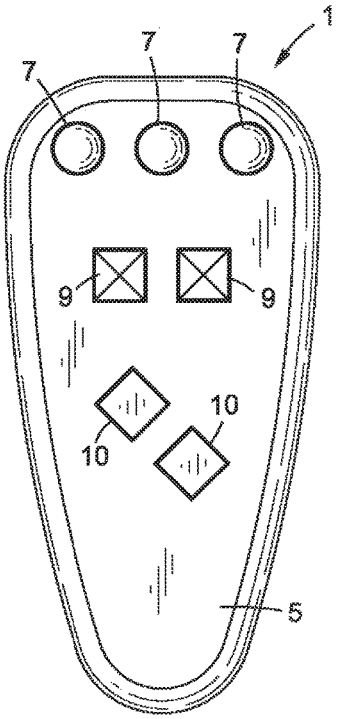
FIG. 4 is a bottom view of the hand-held count indicator shown in FIG. 1.

Referring initially to FIGS. 1-4 of the drawings, there is shown a first preferred embodiment for a hand-held count indicator 1 of the kind that can be used by a baseball umpire and is adapted to provide a tactile indication of balls, strikes and outs commonly associated with the game of baseball. The count indicator 1 is compact so as to have a size that can be comfortably held in the hand and manipulated by the fingers of the umpire. As an important improvement of the count indicator 1 herein disclosed when compared to conventional hand-held count indicators, the umpire can keep track and at all times remain aware of balls, strikes and outs without having to shift his eyes and attention away from the game to look at the count indicator.

The hand-held count indicator 1 is manufactured (e.g., molded) from a durable (e.g., plastic) material. The count indicator has a top 3 and a bottom 5 that are positioned one over the other and snapped together by means of clasps 2 (best shown in FIGS. 5 and 6). First, second and third rows of (e.g., plastic) indicator pins are slidable reciprocally through the count indicator 1 between the top 3 and bottom 5 thereof to provide the umpire with a tactile indication of the balls, strikes and outs at any time during play. The first and second rows of indicator pins are arranged in parallel alignment, while the third row of indicator pins is skewed relative to the first and second rows to help the umpire distinguish one row from another. The tops of the first row of indicator pins 7 that extend outwardly from the top 3 of the count indicator 1 have a first distinctive (e.g., domed) shape to indicate balls. Since a baseball player will take his base when the fourth ball is thrown, only three of the domed indicator pins 7 are required to be manipulated by the umpire in the count indicator 1.

The tops of the second row of indicator pins 9 that extend outwardly from the top 3 of the count indicator 1 have a second distinctive (e.g. pointed) shape to indicate strikes. Since a baseball player is called out when the third strike is called, only two of the pointed indicator pins 9 are required to be manipulated by the umpire in the count indicator 1.

The top of the third row of indicator pins 10 that extend outwardly from the top 3 of the count indicator 1 have a third distinctive (e.g., flat) shape to indicate outs. Since an inning is over after the third out, only two of the flat indicator pins 10 are required to be manipulated by the umpire in the count indicator 1.

The particular shapes of the aforementioned domed, pointed and flat tops of the first, second and third rows of indicator pins 7, 9 and 10 that are shown herein and described above are a matter of choice. However, the rows of indicator pins must have distinctively different shapes that are tactilely distinguishable by touch from one another so as to be easily recognized by the umpire. Although it is not required to enable the umpire to keep track, the words BALLS, STRIKES and OUTS can be molded into the top 3 of the count indicator 1 below the location of the first, second and third rows of indicator pins 7, 9 and 10.

Because the first row of indicator pins 7 have domed tops, each indicator pin from the first row extending through the count indicator 1 ideally has a cylindrical body. Each indicator pin from the second and third rows of indicator pins 9 and 10 ideally has a rectangular body extending through the count indicator 1. However, the precise shapes of the bodies of the rows of indicator pins 7, 9 and 10 are not to be regarded as a limitation of this invention.

While the tops of the rows of indicator pins 7, 9 and 10 have been described as having distinctively different and tactilely recognizable shapes, in order to facilitate the manufacture of the count indicator 1 while improving the ability of the umpire to tactilely distinguish one row from another, the opposite bottoms of the indicator pins ideally have shapes that are identical to the shapes of the tops. The length of each indicator pin must be sufficient so that at least the top or the bottom thereof will extend outwardly from the top 3 or the bottom 5 of the count indicator 1 depending upon the baseball count to be indicated and the direction of a finger generated pushing force that is applied by the umpire to one or more of the indicator pins for a purpose to be described hereinafter.

Figure 5:
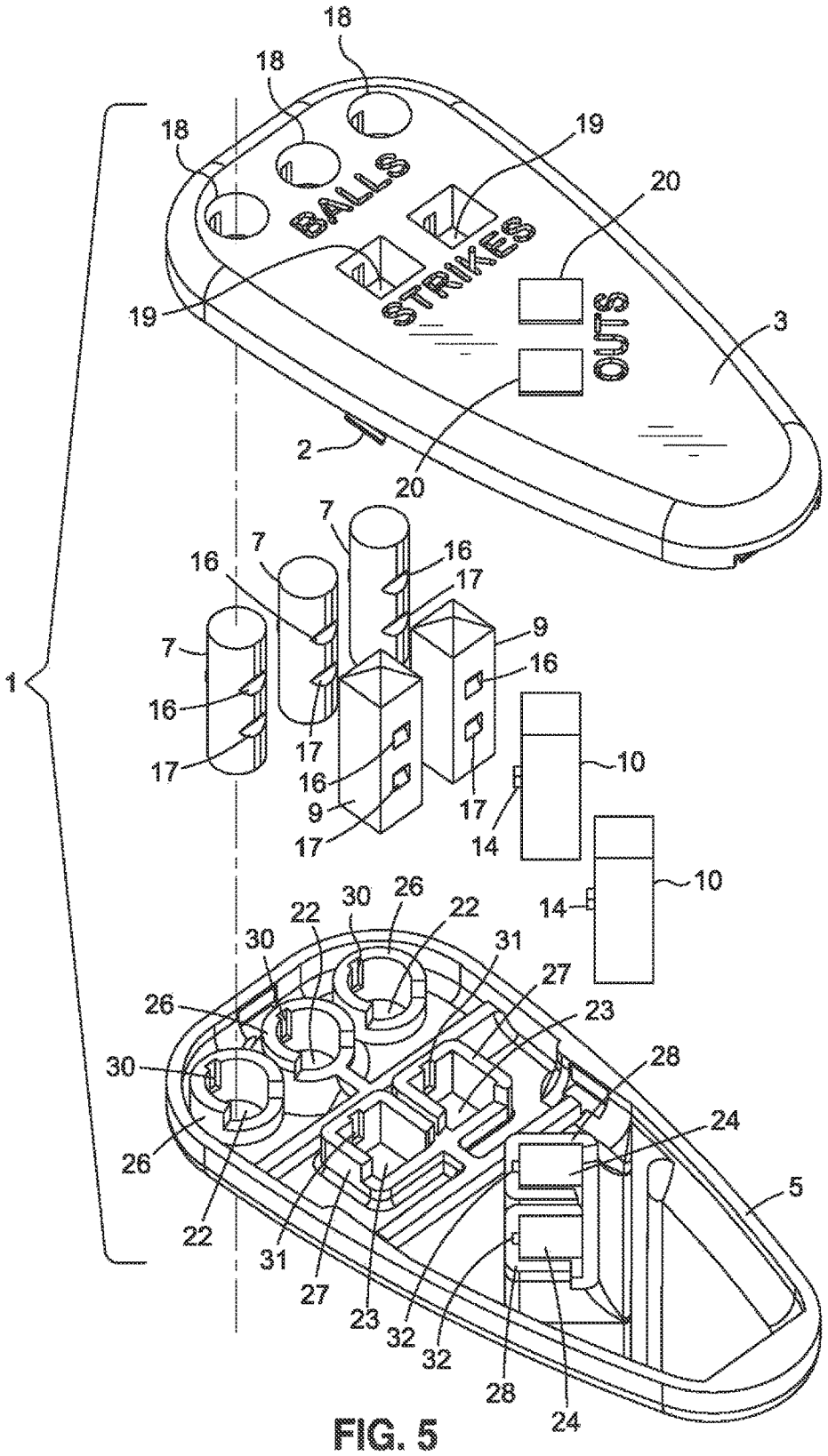
FIGS. 5 and 6 show exploded views of the hand-held count indicator including a top, a bottom lying opposite the top, rows of flexible locking fingers, and the first, second and third rows of indicator pins which are slidable between the top and the bottom of the device to indicate strikes, balls and outs.
Figure 6:
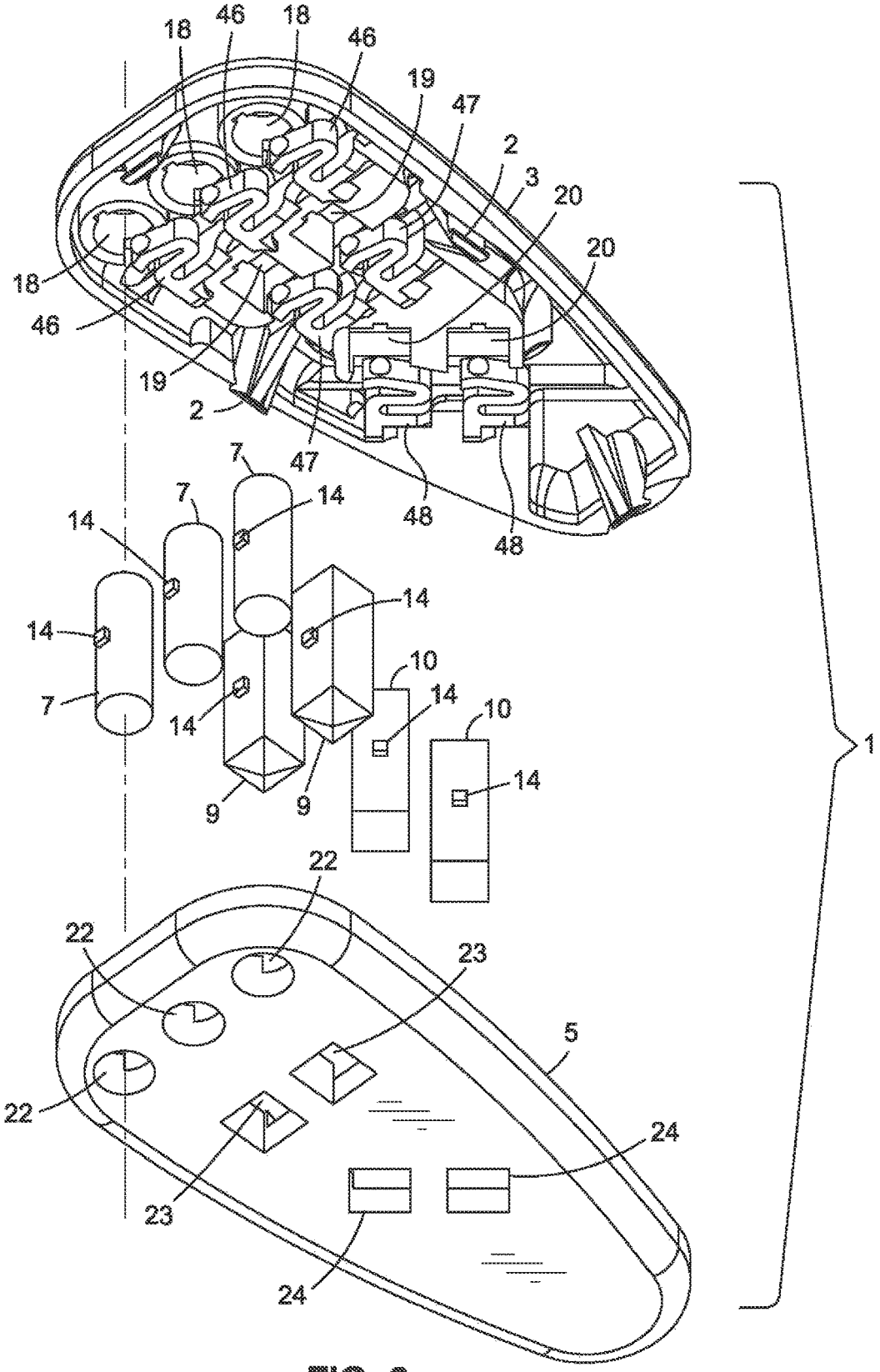

FIGS. 5 and 6 of the drawings illustrate details of the rows of indicator pins 7, 9 and 10 which are adapted to slide reciprocally through (in response to a finger generated pushing force applied thereto) and be held in place within the hand-held count indicator 1 to provide a tactile indication to the umpire of the balls, strikes and outs at any time during play. Each indicator pin 7, 9 and 10 has a stop 14 projecting outwardly from one side thereof. Each indicator pin 7, 9 and 10 also has an upper and a lower locking detent or recess 16 and 17 formed in the opposite side thereof. The upper and lower locking detents 16 and 17 of the indicator pins 7, 9 and 10 may have an identical or different shape.

Referring concurrently now to FIGS. 5-8 of the drawings, the top 3 of the hand-held count indicator 1 (best shown in FIG. 7) is shown with a corresponding number of rows of upper indicator pin receiving holes 18, 19 and 20 formed therethrough to slidably receive respective ones of the first, second and third rows of indicator pins 7, 9 and 10.

Likewise, the bottom 5 of the count indicator 1 (best shown in FIG. 8) is also shown with rows of lower indicator pin receiving holes 22, 23 and 24 formed therethrough to slidably receive the rows of indicator pins 7, 9 and 10. When the top and bottom 3 and 5 of the count indicator 1 are snapped together so as to be held by clasps 2 one above the other, opposing first, second and third pairs of upper and lower indicator pin receiving holes 18 and 22, 19 and 23, and 20 and 24 are axially aligned with one another.

Each axially aligned pair of upper and lower indicator pin receiving holes 18 and 22, 19 and 23, and 20 and 24 has a shape to accommodate therewithin correspondingly shaped ones of the first, second and third rows of indicator pins 7, 9 and 10. Therefore, the axially aligned pair of pin receiving holes 18 and 22 has a round shape to match the cylindrical shape of the first row of indicator pins 7. Each of the axially aligned pairs of pin receiving holes 19 and 23 and 20 and 24 has a rectangular shape to match the rectangular shape of the second and third rows of indicator pins 9 and 10.

The opposing faces located inwardly of and below the top 3 and the bottom 5 of the hand-held count indicator 1 have upper and lower framework which are positioned face-to-face when the top and bottom are snapped together one over the other. The framework is formed (e.g., molded) inside of the top 3 and bottom 5 to communicate with the axially aligned pairs of the upper and lower pin receiving holes 18 and 22, 19 and 23, and 20 and 24 that are formed through the count indicator 1 to receive the indicator pins 7, 9 and 10 which slide therethrough in response to finger generated pushing forces applied to selected ones of the pins of the umpire. As will now be explained, the upper and lower framework cooperates with one another to hold the indicator pins 7, 9 and 10 in place within the count indicator 1 and prevent the indicator pins 7, 9 and 10 from being pushed entirely through and becoming separated from count indicator 1.

More particularly, the lower framework located at the inwardly facing side of the bottom 5 of the hand-held count indicator 1 (best shown in FIGS. 5 and 8) includes a first set of three lower pin receiving walls 26 which surround the three round lower indicator pin receiving holes 22. The framework at the bottom 5 of count indicator 1 also includes a second set of two lower pin receiving walls 27 which surround the two rectangular lower indicator pin receiving holes 23. The framework at the bottom of count indicators further includes a third set of two lower pin receiving walls 28 which surround the two rectangular lower indicator pin receiving holes 24. A first guide channel 30 run axially along each of the lower pin receiving walls 26, a second guide channel 31 runs axially along each of the lower pin receiving walls 27, and a third guide channel 32 runs axially along each of the lower pin receiving walls 28.

Figure 7:
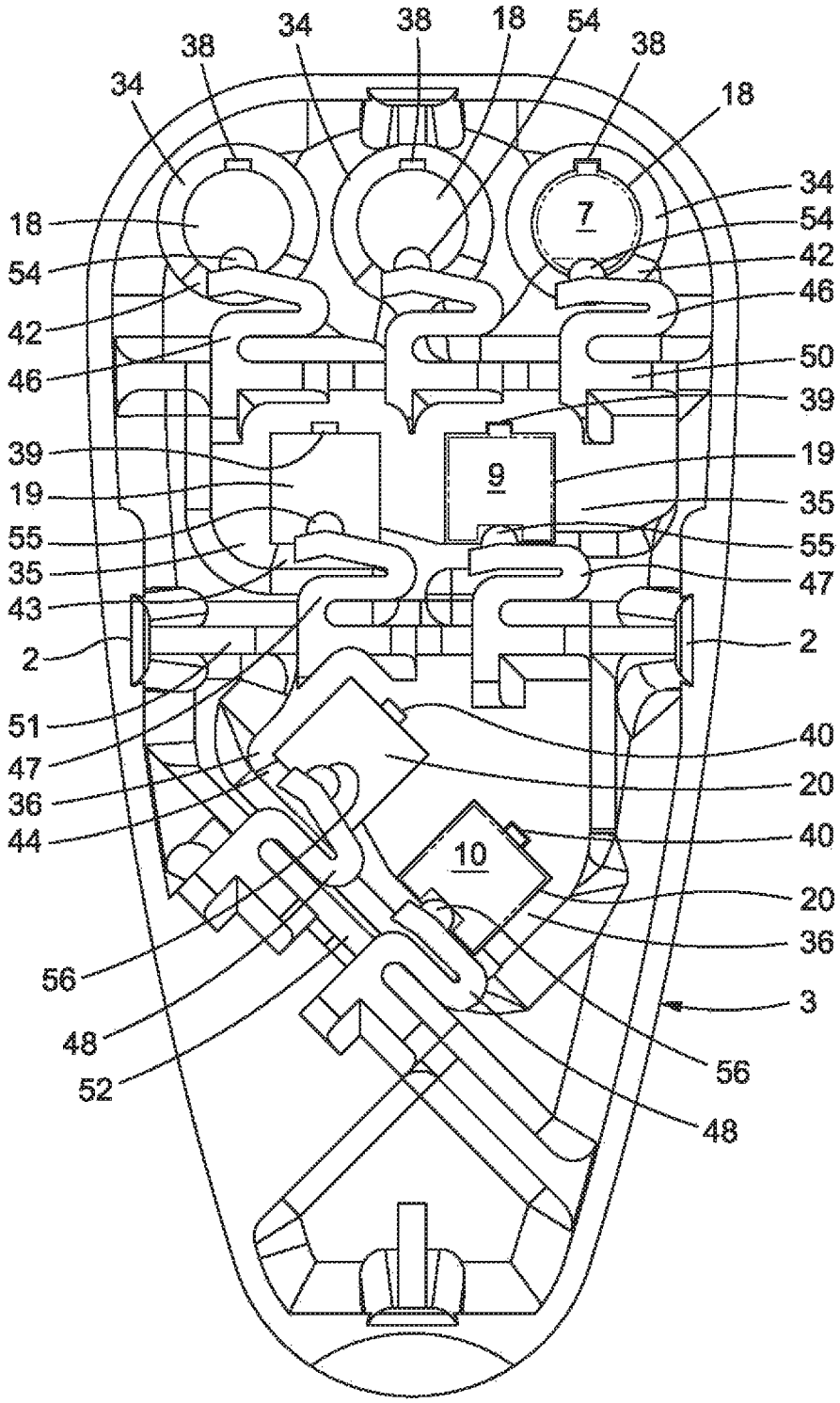
FIG. 7 illustrates an enlargement of the top of the hand-held count indicator shown in FIG. 6.
Figure 8:
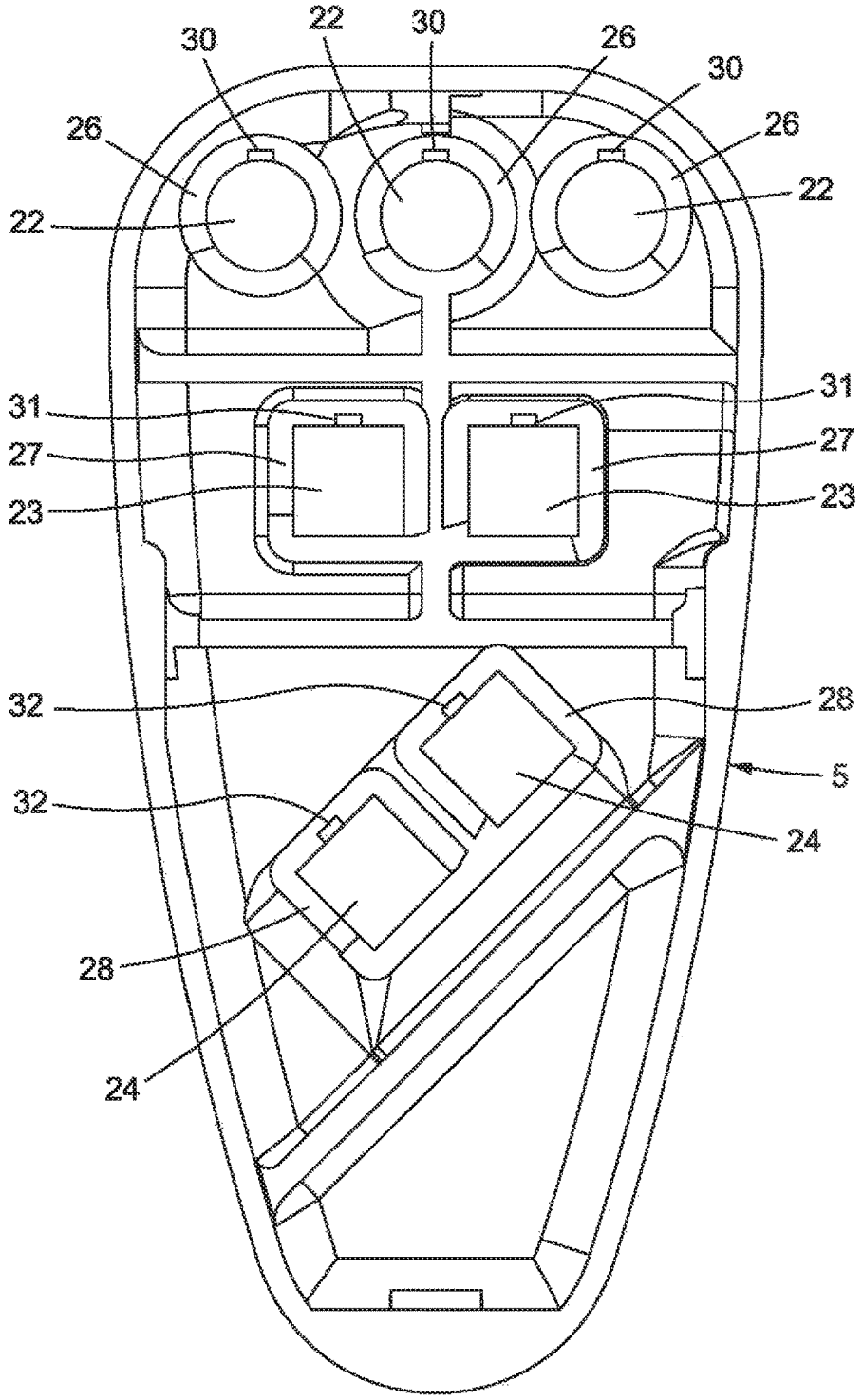
FIG. 8 illustrates an enlargement of the bottom of the hand-held count indicator shown in FIG. 5.

The upper framework located at the inwardly facing side of the top 3 of the hand-held count indicator 1 (best shown in FIGS. 6 and 7) includes a first set of three upper pin receiving walls 34 which surround the three round upper indicator pin receiving holes 18, a second set of two upper pin receiving walls 35 which surround the two rectangular upper indicator pin receiving holes 19, and a third set of two upper pin receiving walls 36 which surround the two rectangular upper indicator pin receiving holes 20. A first guide channel 38 runs axially along each of the upper pin receiving walls 34, a second guide channel 39 runs axially along each of the upper pin receiving walls 35, and a third guide channel 40 runs axially along each of the upper pin receiving walls 36. As is best shown in FIG. 7, a first pin access opening 42 is formed in each of the upper pin receiving walls 34 opposite the first guide channels 38, a second pin access opening 43 is formed in each of the upper pin receiving walls 35 opposite the second guide channels 39, and a third pin access opening 44 is formed in each of the upper pin receiving walls 36 opposite the third guide channels 40.

The upper framework located at the inwardly facing side of the top 3 of the hand-held count indicator 1 also includes sets of locking fingers which act to temporarily lock one or more of the indicator pins 7, 9 and 10 (of FIG. 5) in a raised position or in a depressed position through the count indicator 1 depending upon whether the umpire has applied a pushing force to selected ones of the indicator pins to indicate the baseball count any time during play. The locking fingers are resilient and shaped to have a flexible curved configuration so as to possess a spring-like memory.

More particular, first ends of a first set of three curved flexible locking fingers 46 are coextensively and hingedly connected to a first locking finger support 50 that runs laterally across the top 3 of count indicator 1. Opposite ends of the locking fingers 46 have first locking protrusions (e.g., balls) 54 molded thereon and extending therefrom. The locking balls 54 are positioned by respective locking fingers 46 so as to be received through the first pin access openings 42 formed in the upper pin receiving walls 34 and located within the upper indicator pin receiving holes 18.

First ends of a second set of two curved flexible locking fingers 47 are coextensively and hingedly connected to a second locking finger support 51 that runs laterally across the top 3 of count indicator 1 below the first locking finger support 50. Opposite ends of the locking fingers 47 have second locking protrusions (i.e., balls) 55 molded thereon and extending therefrom. The locking balls 55 are positioned by respective locking fingers 47 so as to be received through the second pin across openings 43 formed in the upper pin receiving walls 35 and located within the upper indicator pin receiving holes 19.

First ends of a third set of two curved flexible locking fingers 48 are coextensively and hingedly connected to a third locking finger support 52 that runs diagonally across the top 3 of the count indicator 1 below the second locking finger support 51. Opposite ends of the locking fingers 48 have third protrusions (e.g., balls) 56 molded thereon and extending therefrom. The locking balls 56 are positioned by respective locking fingers 48 so as to be received through the third pin access openings 44 formed in the upper pin receiving walls 36 and located within the upper indicator pin receiving holes 20.

The operation of the hand-held count indicator 1 to enable a baseball umpire to recognize the balls, strikes and outs recorded during the game of baseball by using only his sense of touch is now described while referring concurrently to FIGS. 1-10 of the drawings. At the start of a new inning when the first batter comes to the plate to begin play, no balls or strikes have been called on the batter and no outs have been recorded. Therefore, all of the indicator pins 7, 9 and 10 from the first, second and third rows thereof are initially located and retained in a raised position (best shown in FIG. 1) relative to the top 3 of the count indicator.

Figure 9:
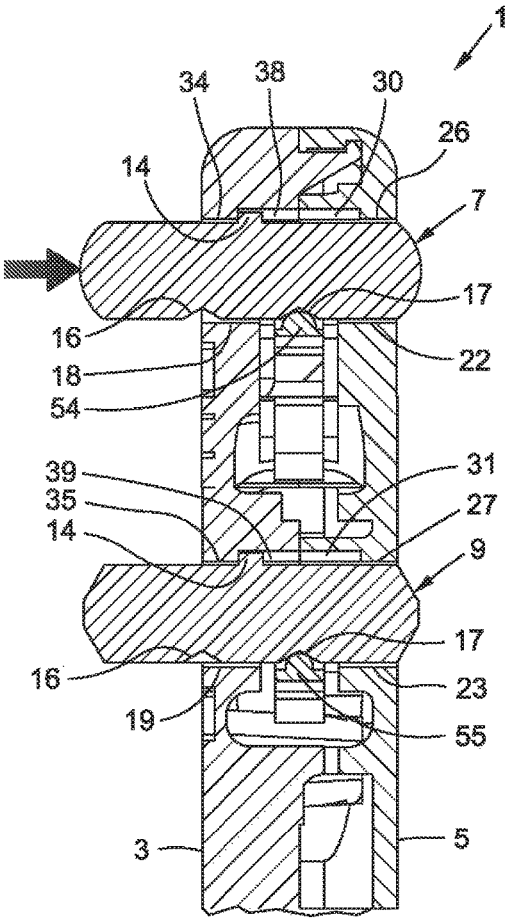
FIG. 9 is a cross-section taken along lines 9-9 of FIG. 2 to show particular indicator pins from the first and second rows of indicator pins in their raised position prior to a ball or a strike being called by the umpire.

That is, and referring specifically to FIG. 9, in its raised position, each of the indicator pins (e.g., 7 and 9) extends outwardly from the top 3 of the count indicator 1. With the indicator pins 7 in their raised position, the respective stops 14 thereof are located against an upper end wall of the first guide channels 38 formed in the upper pin receiving walls 34 in the framework below the top 3 of device 1. Likewise, with the indicator pins 9 also in their raised position, the respective stops 14 thereof are located against an upper end wall of the second guide channels 39 formed in the upper pin receiving walls 35 below the top 3 of device 1. The receipt of the stops 14 against the upper end walls of the first and second guide channels 38 and 39 limits the upward travel of the indicator pins 7 and 9 through the upper indicator pin receiving holes 18 and 19 and prevents the pins 7 and 9 from sliding (i.e., being pushed) completely out of and being removed from the count indicator 1.

With the first and second rows of indicator pins 7 and 9 located in their raised position as shown in FIG. 9, the first and second locking protrusions (e.g., balls) 54 and 55 are pushed by the first and second sets of flexible spring-like locking fingers 46 and 47 (of FIG. 7) into locking engagement within respective lower locking detents 17 formed in one side of the indicator pins 7 and 9. Accordingly, the receipt by the locking balls 54 and 55 within the locking detents 17 holds the indicator pins 7 and 9 in their raised position and prevents the indicator pins from inadvertently sliding downwardly through the axially aligned pairs of upper and lower indicator pin receiving holes 18, 22 and 19, 23 which extend through the count indicator 1.

In this case, the umpire can use his finger tip or tips to feel the domed tops of indicator pins 7 and the pointed tops of indicator pins 9 so as to be able to tactilely distinguish one row of indicator pins from the other. When the umpire tactilely senses the first and second rows of indicator pins 7 and 9 standing upwardly in their raised position relative to the top 3 of count indicator 1, he is immediately made aware that no balls or strikes have been called on the batter.

When the first (or next) pitch thrown to the batter is a ball, the umpire generates a downward pushing force with his finger or thumb (in the direction indicated by the directional arrow shown in FIG. 9) against one of the domed indicator pins 7 which is indicative of a ball called for the batter. Accordingly, the domed indicator pin 7 will slide downwardly to its depressed position through the axially aligned pair of upper and lower indicator pin receiving holes 18 and 22 which run through the count indicator 1 (best shown in FIG. 10), whereby the indicator pin 7 now extends outwardly from the bottom 5 of the count indicator 1.

Figure 10:
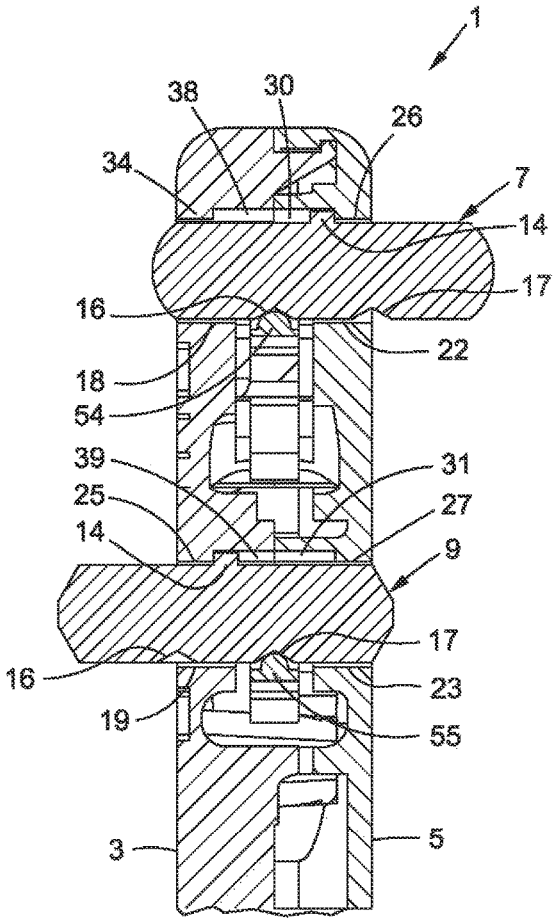
FIG. 10 shows one of the indicator pins from FIG. 9 being pushed by the umpire through the count indicator from its raised position to a depressed position after a ball has been called by the umpire.
Figure 11:
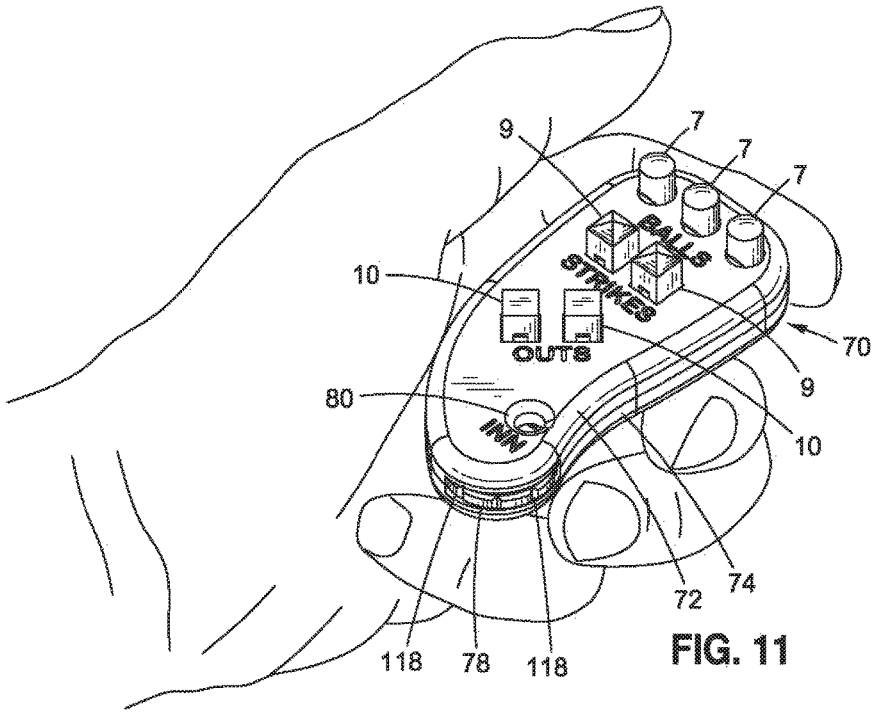
FIG. 11 shows the hand-held count indicator according to a second preferred embodiment of this invention being held in the hand of an umpire with first, second and third rows of indicator pins standing upwardly from the device in a raised position at the start of an inning during the game of baseball.
Figure 12:
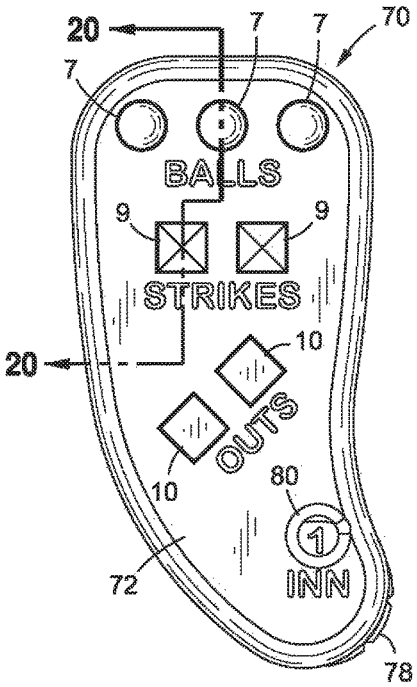
FIG. 12 is a top view of the hand-held count indicator shown in FIG. 11.
Figure 13:
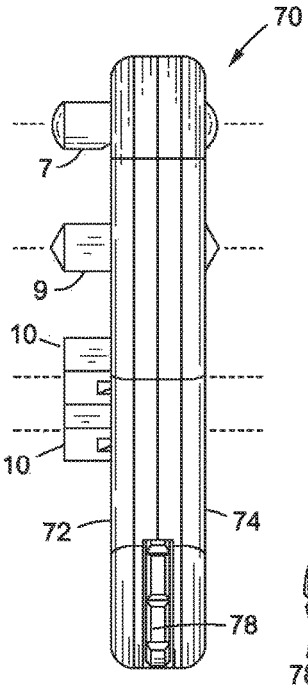
FIG. 13 is a side view of the hand-held count indicator shown in FIG. 11.
Figure 14:
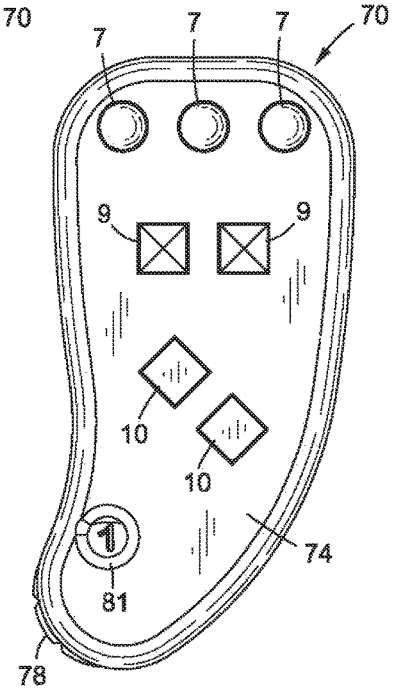
FIG. 14 is a bottom view of the hand-held count indicator shown in FIG. 11.

With the indicator pin 7 pushed to its depressed position as shown in FIG. 10, the stop 14 thereof is correspondingly moved against a lower end wall of the first guide channel 30 formed in the lower pin receiving wall 26 at the bottom 5 of the count indicator 1. The receipt of the stop 14 against the lower end wall of the first guide channel 30 limits the downward travel of the indicator pin 7 to its depressed position and prevents the pin 7 from sliding (i.e., being pushed) completely out of and being removed from the bottom 5 of the count indicator 1.

When the indicator pin 7 is pushed by the umpire and slides to its depressed position shown in FIG. 10, the first locking ball 54 will be withdrawn from the lower locking detent 17 formed in the indicator pin 7 and pushed by the flexible, spring-like locking finger 46 (of FIG. 7) into locking engagement within the upper locking detent 16 thereof. The engagement of the locking ball 54 by the locking detent 16 holds the indicator pin 7 in its depressed position and prevents the indicator pin from inadvertently sliding upwardly through the axially aligned pair of upper and lower indicator pin receiving holes 18 and 22 which extend through the count indicator 1.

The umpire can once again use his finger tip or tips to located (i.e., feel) the domed top of the indicator pin 7 relative to the top 3 of the count indicator 1. When the umpire tactilely senses that the indicator pin 7 has been pushed to its depressed position with its domed top lying flush with the top 3 of the count indicator 1, he is immediately made aware that (at least) one ball has been called for the batter.

At the present time, no strikes have yet to be called against the batter. Therefore, no pushing force will be applied by the umpire to the pointed indicator pin 9, such that the indicator pin 9 shown in FIG. 10 remains stationary in its original raised position as shown in FIG. 9.

When a new batter enters play, the umpire will push the rows of domed and pointed indicator pins 7 and 9 upwardly from their depressed position extending outwardly from the bottom 5 of the count indicator 1 to their raised upstanding position extending outwardly from the top 3 of the device 1. The count indicator 1 is now ready to be used by the umpire once again in the manner described above to keep track of and provide a tactile indication of the balls and strikes called on the new batter.

FIGS. 11-14 of the drawings shows a second preferred embodiment for a hand-held count indicator 70 that is ideal to be used by a baseball umpire to provide a tactile indication of balls, strikes and outs associated with the game of baseball. Like the count indicator 1 of FIGS. 1-10, the count indicator 70 of FIGS. 11-14 is sized to be comfortably held in the hand and manipulated by the fingers of the umpire. Also like the previously described count indicator 1, the count indicator 70 enables the umpire to keep track of and remain aware of balls, strikes and outs without having to take his eyes and focus off the game to look at the device.

Figure 15:
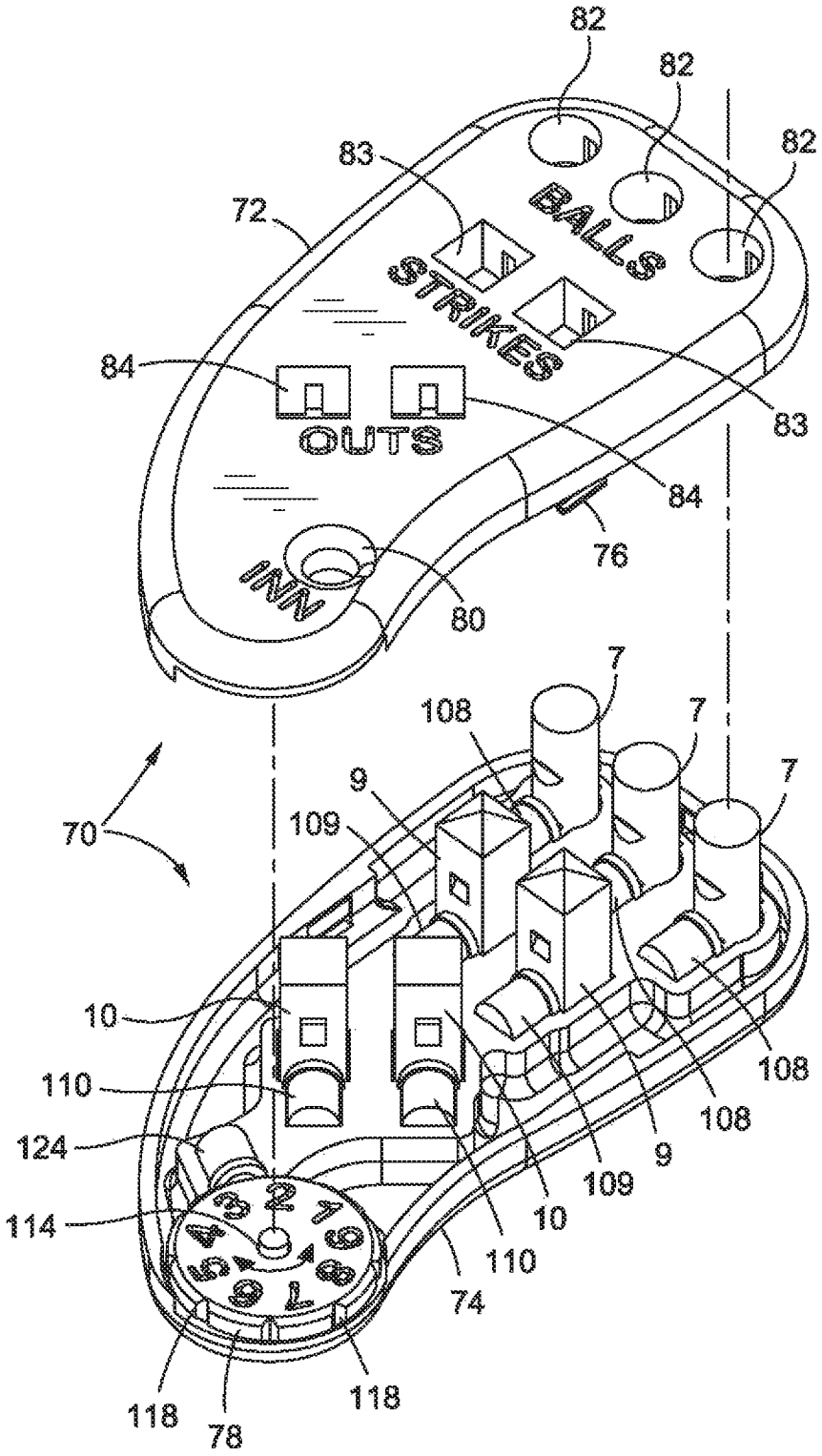
FIG. 15 shows the top of the hand-held count indicator detached from the bottom thereof.
Figure 16:
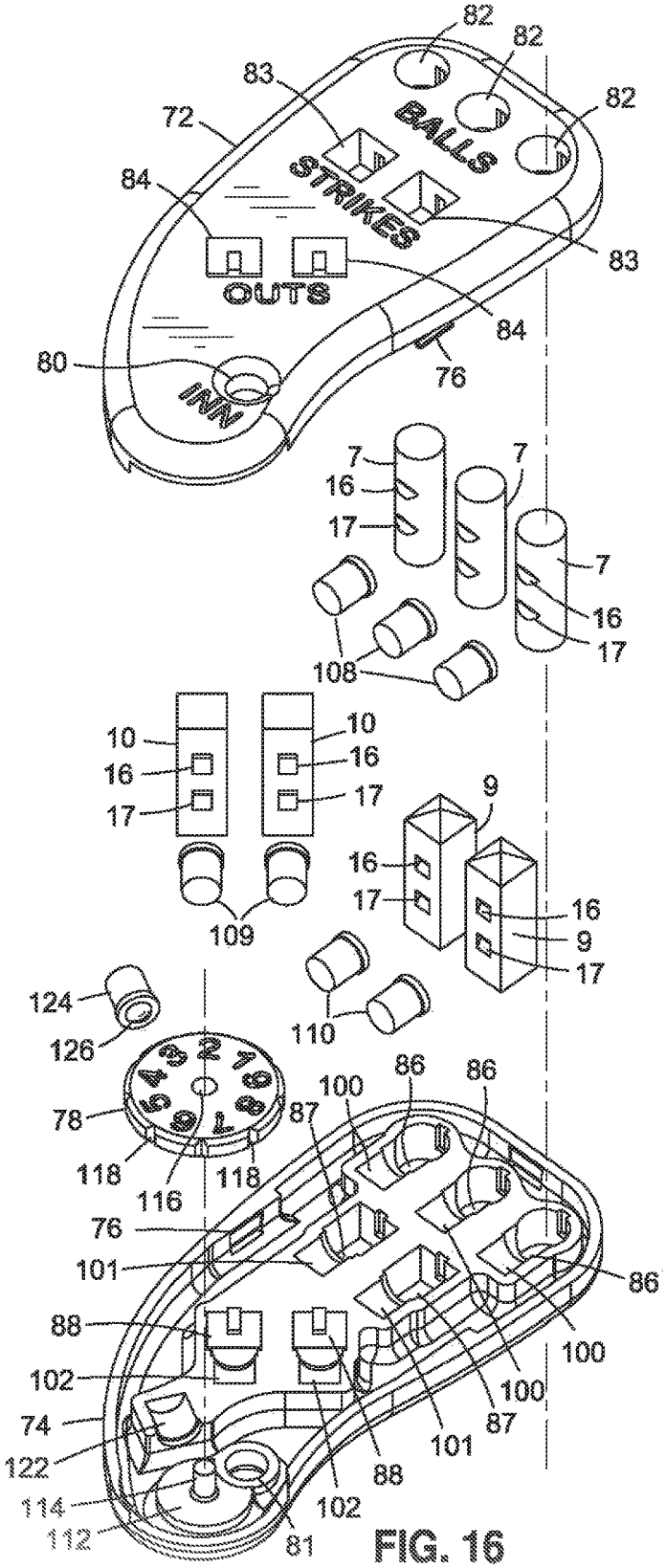
FIGS. 16 and 17 show exploded views of the hand-held count indicator including the top, the bottom lying opposite the top, rows of spring-actuated ball nose plungers, and the first, second and third rows of indicator pins which are slidable between the top and the bottom of the device to indicate strikes, balls and outs.

The hand-held count indicator 70 has a top 72 and a bottom 74 that are positioned one over the other and snapped together by means of clasps 76 (best shown in FIGS. 15 and 16). First, second and third rows of distinctively shaped indicator pins are slidable through the count indicator 70 between the top 72 and the bottom 74 thereof to provide the umpire with a tactile indication of balls, strikes and outs at any time during play. The number and shape of the indicator pins carried by the count indicator 70 of FIGS. 11-14 may be identical to those of the indicator pins 7, 9 and 10 shown and described while referring to FIGS. 1-10. Therefore, identical reference numerals will be used to indicate the rows of indicator pins 7, 9 and 10 carried by both count indicators 1 and 70.

Figure 17:
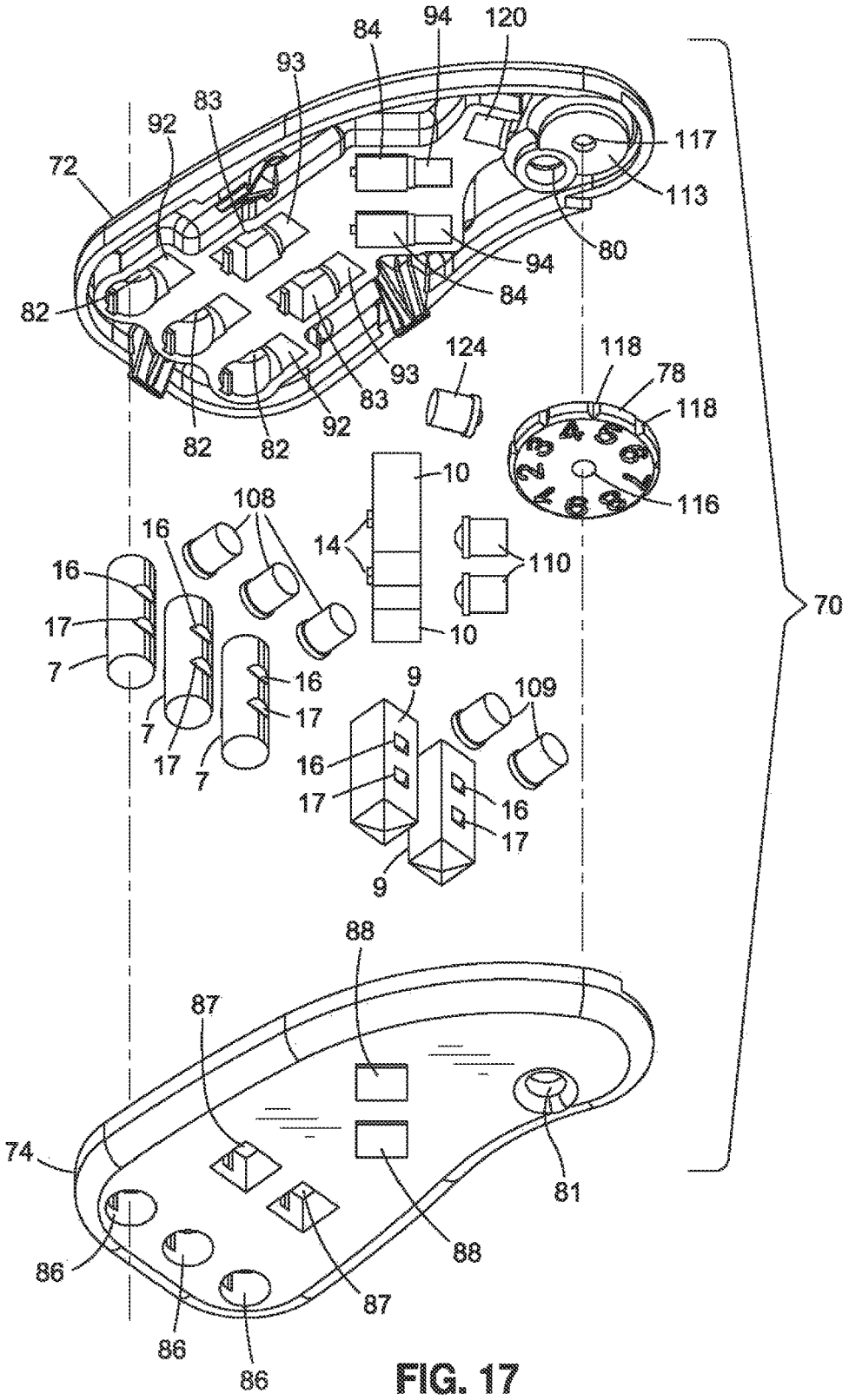

Unlike the count indicator 1 of FIGS. 1-10, the count indicator 70 of FIGS. 11-14 includes an inning indicator wheel 78 (best shown in FIGS. 15-17) that is rotatable relative to the top 72 and the bottom 74 of count indicator 70. The inning indicating wheel 78 is marked with and surrounded on both sides by the numerals 1-9 to designate the innings played during a traditional nine inning baseball game. As the wheel 78 is rotated by the umpire in a manner that will soon be described, the numeral that is indicative of the current inning being played is visible through windows 80 and 81 formed through the top 72 and the bottom 74 of the count indicator 70.

As in the case of the previously described count indicator 1, and referring now to FIGS. 15-19 of the drawings, when the top 72 and bottom 74 of the count indicator 70 are snapped together so as to be held by clasps 76 one above the other, rows of opposing first, second and third pairs of upper and lower indicator pin receiving holes 82 and 86, 83 and 87, and 84 and 88 are axially aligned with one another. The rows of upper and lower axially aligned indicator pin receiving holes are formed through the top 72 and the bottom 74 of the count indicator 70 to slidably receive respective first, second and third rows of the indicator pins 7, 9 and 10. Each axially aligned pair of upper and lower indicator pin receiving holes 82 and 86, 83 and 87, and 84 and 88 has a shape that corresponds to and accommodates therewithin correspondingly shaped ones of the domed, pointed and flat indicator pins 7, 9 and 10.

Figure 18:
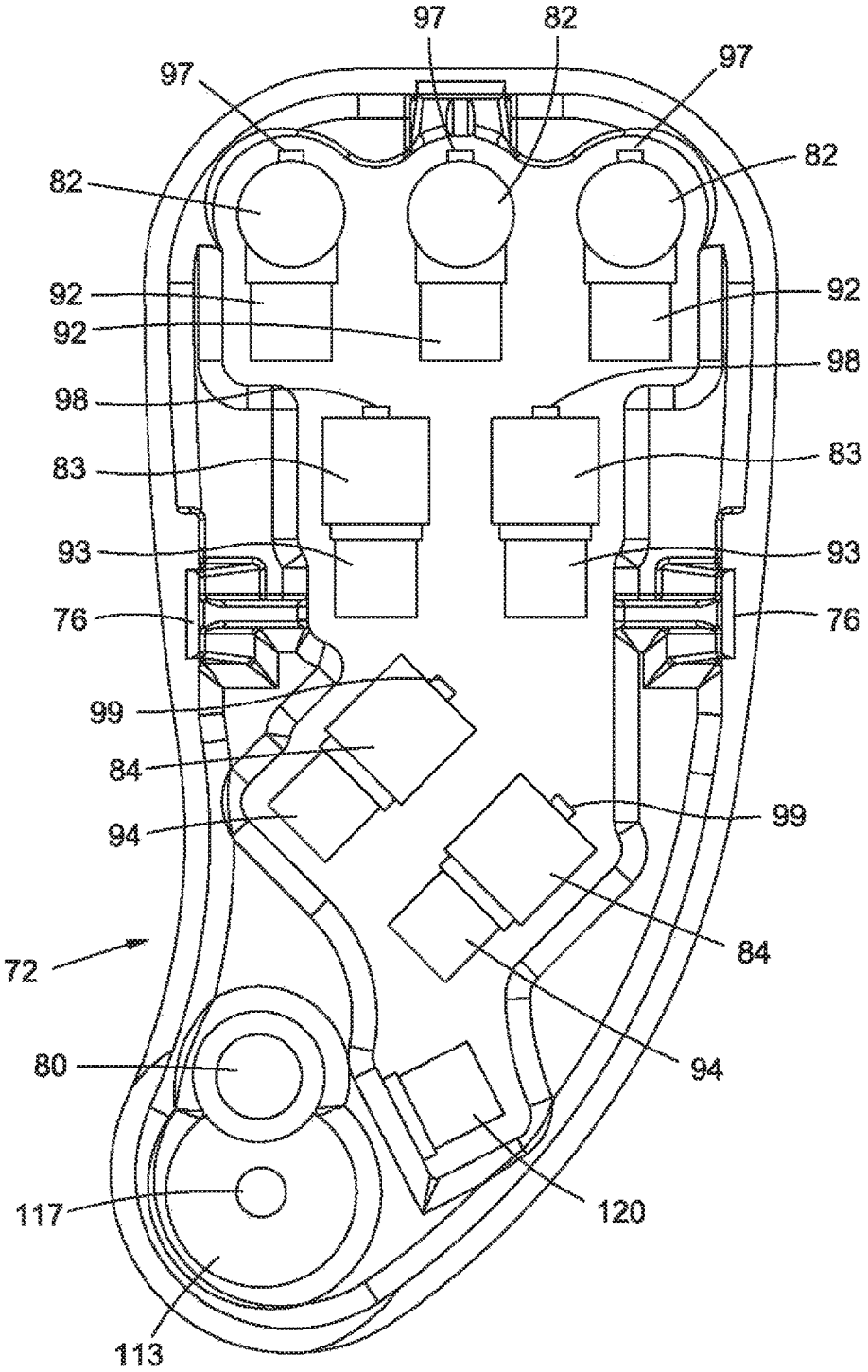
FIG. 18 illustrates an enlargement of the top of the hand-held count indicator shown in FIG. 17.
Figure 19:
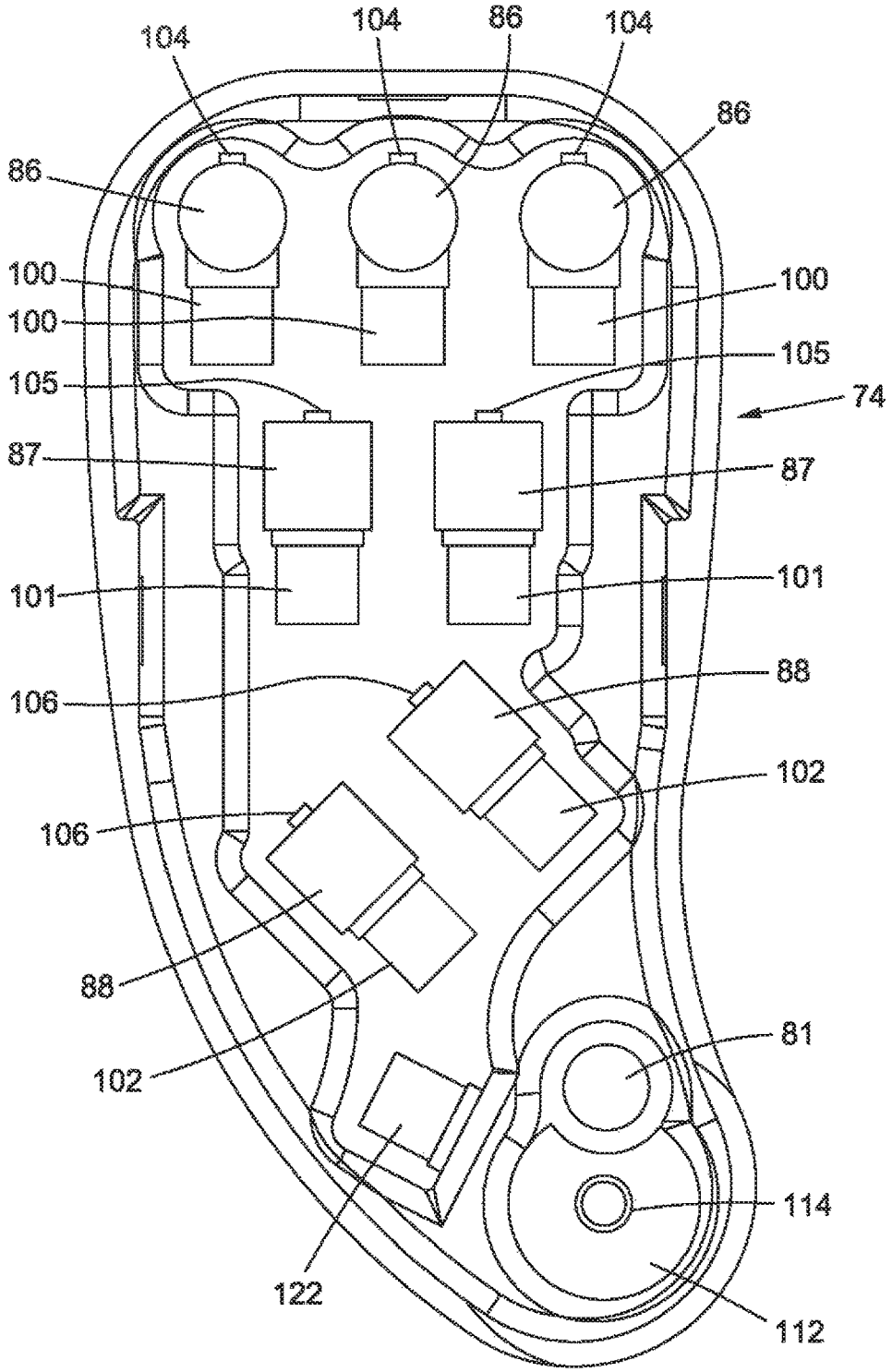
FIG. 19 illustrates an enlargement of the bottom of the hand-held count indicator shown in FIG. 16.

The opposing faces located inwardly of and below the top 72 and the bottom 74 of the hand-held count indicator 70 which lie face-to-face one another are molded to accommodate rows of conventional spring-actuated ball-nose plungers. Referring in this regard to FIGS. 18 and 19, first, second and third rows of upper plunger cavities 92, 93 and 94 are located adjacent and communicate with respective first, second and third rows of the upper indicator pin receiving holes 82, 83 and 84 formed through the top 72 of the count indicator 1 (best shown in FIG. 18). Also communicating with the rows of upper indicator pin receiving holes 82, 83 and 84 and located opposite the upper plunger cavities 92, 93 and 94 are first, second and third rows of upper guide channels 97, 98 and 99.

As is best shown in FIG. 19, first, second and third rows of lower plunger cavities 100, 101 and 102 are located adjacent and communicate with respective first, second and third rows of the lower indicator pin receiving holes 86, 87 and 88 formed through the bottom of the count indicator 70. Also communicating with the rows of lower indicator pin receiving holes and located opposite the lower plunger cavities 100, 101 and 102 are first, second and third rows of lower guide channels 104, 105 and 106.

First, second and third rows of the aforementioned spring-actuated ball-nose plungers 108, 109 and 110 are located within respective pairs of upper and lower plunger cavities 92 and 100, 93 and 101, and 94 and 102 that are molded below the top 72 and bottom 74 of the hand-held count indicator 70 and aligned one above the other (best shown in FIG. 15). As will be explained when referring to FIGS. 20 and 21, the ball-nose plungers 108, 109 and 110 communicate with respective ones of the indicator pins 7, 9 and 10 to control the position thereof through the count indicator 70 in response to a pushing force applied thereto by the umpire.

As is best shown in FIG. 16, a smooth, disk-like wheel support 112 is located at the inwardly facing side of the bottom 74 of the count indicator 70. A cylindrical post 114 stands upwardly from the wheel support 112. The post 114 is first moved through a hole 116 formed in the center of the inning indicator wheel 78 and then inserted within a hole 117 formed in an opposing smooth, disk-like wheel support 113 (best shown in FIG. 17) that is located on the inwardly facing side of the top 72 of the count indicator 70. The wheel 78 lays against the disk-like wheel support 112 on the bottom 74 and the opposing disk-like wheel support 113 on the top 72 of the count indicator 70 while it rotates around the cylindrical post 114 in response to a pushing force applied thereto by the umpire as the innings of the game are incrementally increased. A set of uniformly spaced notches 118 are formed in the edge around the inning indicator wheel 78.

A pair of upper and lower wheel control plunger cavities 120 and 122 are molded one above the other below the top 72 and the bottom 74 of the count indicator 70. The upper plunger control cavity 120 is located adjacent the disk-like wheel support 113 of the top 72 of count indicator 70 (best shown in FIG. 18), and the lower plunger control cavity 122 is located adjacent the disk-like wheel support 112 of the bottom 74 of the device 70 (best shown in FIG. 19). A spring-actuated ball nose plunger 124 (best shown in FIGS. 15 and 16) is located within the opposing upper and lower wheel control plunger cavities 120 and 122 so as to communicate with a particular one of the notches 118 formed in the edge of wheel 78 depending upon the inning during which the baseball game is being played.

Figure 20:
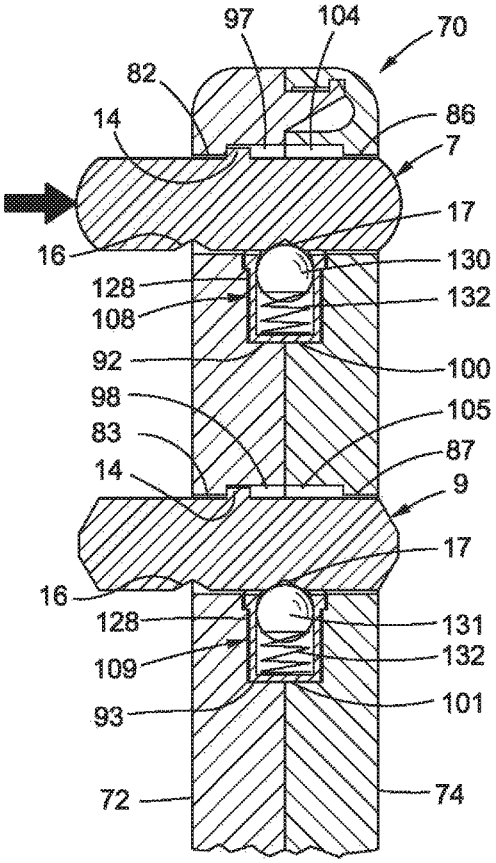
FIG. 20 is a cross-section taken along lines 20-20 of FIG. 12 to show particular indicator pins from the first and second rows of indicator pins in their raised position prior to a ball or a strike being called by the umpire.
Figure 21:
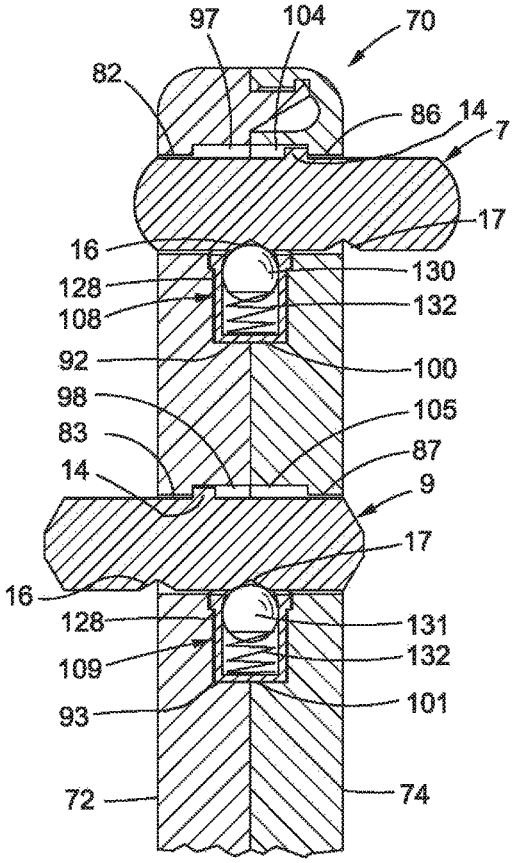
FIG. 21 shows one of the indicator pins from FIG. 20 being pushed by the umpire through the count indicator from its raised position to a depressed position after a ball has been called by the umpire.

Turning now to FIGS. 20 and 21 of the drawings, the hand-held count indicator 70 is shown at the start of a new inning as the first batter comes to the plate to begin play when no balls or strikes has been called on the batter and no outs have been recorded. Therefore, all of the indicator pins 7, 9 and 10 from the first, second and third rows thereof are initially located and retained in a raised position (best shown in FIG. 11) relative to the top 72 of the count indicator 70.

That is, and as best shown in FIG. 20, in their raised position, each of the indicator pins (e.g., 7 and 9) extends outwardly from the top 72 of the count indicator 70. With the indicator pins 7 in their raised position as shown, the respective stops 14 thereof are located against an upper end wall of the first rows of upper guide channels 97 formed below the top 72 of device 70. Likewise, with the indicator pins 9 also in their raised position as shown, the respective stops 14 thereof are located against an upper end wall of the second row of upper guide channels 98 below the top 72 of device 70. The receipt of the stops 14 against the upper end walls of the upper guide channels 97 and 98 limits the upward travel of the indicator pins 7 and 9 through the upper indicator pin receiving holes 82 and 83 and prevents the pins 7 and 9 from sliding (i.e., being pushed) completely out of and being removed from the count indicator 70.

Each of the spring-actuated ball nose plungers (e.g., 108 and 109) is known commercially and includes an open-ended hollow cylindrical plastic shell 128, a protrusion (e.g., a metal ball) 130 and 131 that is slidable through the shell 128, and a (e.g., coil) spring 138 located within the shell 128 to engage and urge the balls 130 and 131 to slide towards the open end of shells 128. The open end of the shell 128 of each ball nose plunger 108 and 109 has a peripheral lip extending therearound which prevents the spring 132 from pushing the balls 130 and 131 completely out of and being removed from shell 128. The ball nose plungers 108 and 109 are located within respective pairs of upper and lower plunger cavities 92, 100 and 93, 101 that are molded below the top 72 and the bottom 74 of count indicator 70.

With the first and second rows of indicator pins 7 and 9 located in their raised position as shown in FIG. 20, the first and second rows of balls 130 and 131 are pushed by springs 132 through the shells 128 of ball nose plungers 108 and 109 and into locking engagement within respective lower locking detents 17 formed in one side of the indicator pins 7 and 9. Accordingly, the receipt of the balls 130 and 131 within the locking detents 17 holds the indicator pins 7 and 9 in their raised position and prevents the indicator pins from inadvertently sliding downwardly through the axially aligned pairs of upper and lower indicator pin receiving holes 82, 86 and 83, 87 which extend through the count indicator 70.

In this case, the umpire can use his finger tip or tips to feel the domed tops of indicator pins 7 and the pointed tops of indicator pins 9 so as to be able to tactilely distinguish one row of indicator pins from the other. When the umpire senses the first and second rows of indicator pins 7 and 9 standing upwardly in their raised position relative to the top 3 of count indicator 1, he is immediately made aware that no balls or strikes have been called on the batter.

When the first (or next) pitch thrown to the batter is a ball, the umpire generates a downward pushing force with his finger or thumb (in the direction indicated by the directional arrow shown in FIG. 20) against one of the domed indicator pins 7 which is indicative of a ball called for the batter. Accordingly, the domed indicator pin 7 will slide downwardly to its depressed position through the axially aligned pair of upper and lower indicator pin receiving holes 82 and 86 which run through the count indicator 70 (best shown in FIG. 21), whereby the indicator pin 7 now extends outwardly from the bottom 74 of the count indicator 70.

With the indicator pin 7 pushed to its depressed position as shown in FIG. 21, the stop 14 thereof is correspondingly moved against a lower end wall of the lower guide channel 104 formed at the bottom 72 of the count indicator 70. The receipt of the stop 14 against the lower end wall of the lower guide channel 104 limits the downward travel of the indicator pin 7 to its depressed position and prevents the pin 7 from sliding (i.e., being pushed) completely out of and being removed from the bottom 74 of the count indicator 70.

When the indicator pin 7 is pushed by the umpire and slides to its depressed position shown in FIG. 21, the ball 130 will be withdrawn from the lower locking detent 17 formed in the indicator pin 7 so as to cause the spring 132 to be momentarily compressed. The spring 132 will expand to push the ball 130 into locking engagement within the upper locking detent 16 of pin 7. The receipt of the ball 130 by the locking detent 16 holds the indicator pin 7 in its depressed position and prevents the indicator pin from inadvertently sliding upwardly through the axially aligned pair of upper and lower indicator pin receiving holes 82 and 86 which extend through the count indicator 70.

The umpire can once again use his finger tip or tips to locate (i.e., feel) the domed top of the indicator pin 7 relative to the top 72 of the count indicator 70. When the umpire tactilely senses that the indicator pin 7 has been pushed to its depressed position with its domed top lying flush with the top 72 of the count indicator 70, he is immediately made aware that (at least) one ball has been called for the batter.

At the present time, no strikes have yet to be called against the batter. Therefore, no pushing force will be applied by the umpire to the pointed indicator pin 9, such that the indicator pin 9 shown in FIG. 21 remains stationary in its original raised position as shown in FIG. 20.

When a new batter enters play, the umpire will push the rows of domed and pointed indicator pins 7 and 9 upwardly from their depressed position extending outwardly from the bottom 74 of the count indicator 70 to their raised upstanding position extending outwardly from the top 72 of the device 70. The count indicator 70 is now ready to be used by the umpire once again in the manner described above to keep track of and provide a tactile indication of the balls and strikes called on the new batter.

The spring-actuated ball nose plunger 124 (of FIGS. 15 and 16) includes the same features and operates in the same manner as the ball nose plungers 108, 109 and 110 that were described while referring to FIGS. 20 and 21. That is, the ball nose plunger 124 has a ball 126 (of FIG. 16) that is pushed by a spring (not shown) into removable receipt by one of the notches 118 of the rotatable inning indicating wheel 78. The ball 126 holds the position of the wheel 78 stationary between the top 72 and bottom 74 of the count indicator 70 so that a designated one of the innings printed on the wheel can be viewed by the umpire through either one of the windows 80 or 81 formed in device 70.

The hand-held count indicators 1 and 70 have been described herein as having particular application for use by an umpire to keep track of balls, strikes and outs during the game of baseball. However, it is to be understood that the principals of this invention can also be utilized by those engaged in playing other sports (e.g., tennis) or different activities so that the count indicators provide users with a tactile indication of a variety of parameters associated with the game or activity to be indicated by corresponding rows of distinctly shaped indicator pins that are manipulated and sensed by the user without the user having to visualize the count indicator.

The invention claimed is:

1. A count indicator to indicate first and second parameters and comprising:

a body having a top and a bottom lying opposite one another;

a first row of indicator pins;

a second row of indicator pins;

each of said indicator pins from said first row having a first shape and being movable relative to said body from a first position extending outwardly from the top of said body to a second position extending outwardly from the bottom of said body to provide an indication of the first parameter;

each of said indicator pins from said second row having a second shape and being movable relative to said body from said first position to said second position to provide an indication of the second parameter; and the first shape of each of said indicator pins from said first row thereof being tactilely distinguishable from the second shape of each of said indicator pins from said second row thereof, whereby the indications of the first and second parameters are determinable by means of manually touching each of the indicator pins from said first and second rows of indicator pins and sensing the respective shapes and the first or second positions thereof relative to said body.

2. The count indicator recited in claim 1, wherein each of said indicator pins from the first row is slidable through said body from said first position to said second position to provide the indication of one of said first or second parameters.

3. The count indicator recited in claim 1, wherein each of said indicator pins from the first row is adapted to slide through the body of said count indicator in response to a manual pushing force applied thereto.

4. The count indicator recited in claim 3, wherein the body of said count indicator is sized to be held in a human hand such that each of said indicator pins is adapted to be responsive to a manual pushing applied thereto by a finger of the human hand.

5. The count indicator recited in claim 1, wherein there is at least one row of holes formed through the body of said count indicator and extending between the top and the bottom of said body, the indicator pins from the first row being received within and slidable between said first and second positions through respective ones of the holes from said one row thereof.

6. The count indicator recited in claim 5, wherein there is a plurality of guide channels having opposing end walls formed through the body of said count indicator and communicating with respective ones of the holes from said one row of holes, and wherein each of the indicator pins from said first row has a stop projecting therefrom and riding through a corresponding one of said plurality of guide channels for receipt against an end wall thereof so as to limit the travel of said indicator pins when said indicator pins slide-through move relative to said body from said first position to said second position.

7. The count indicator recited in claim 5, wherein there is a plurality of locking protrusions located between the top and the bottom of said body, and wherein each of the indicator pins from said first row has first and second locking detents formed therein and located one above the other, each of said locking protrusions from said plurality of locking protrusions being removably received within a respective one of said first or second locking detents from each of said indicator pins to hold said indicator pins at one of said first or second positions relative to the body of said count indicator.

8. The count indicator recited in claim 7, wherein each of said plurality of locking protrusions is a ball carried by a flexible locking arm having a spring memory, said flexible locking arm applying a pushing force against said ball to urge said ball into removable receipt by one of said first or second locking detents of a corresponding one of said indicator pins depending upon whether said indicator pin is located in said first position or said second position.

9. The count indicator recited in claim 7, wherein each of said plurality of locking protrusions is a spring-actuated ball nose plunger having a spring that communicates with a ball to apply a pushing force against said ball to urge said ball into removable receipt by one of said first or second locking detents of a corresponding one of said indicator pins depending upon whether said indicator pin is in said first position or said second position.

10. The count indicator recited in claim 1, further comprising an inning counting wheel having indicia printed thereon to indicate the innings of a game of baseball, said inning counting wheel being mounted for rotation between the top and bottom of the body of said count indicator and having a series of notches formed in and extending around the periphery thereof, and a spring-actuated ball nose plunger located adjacent said inning counting wheel between the top and the bottom of said body and having a spring that communicates with a ball to urge said ball into removable receipt by one of said series of notches formed in said inning counting wheel to prevent a rotation of said wheel.

11. The count indicator recited in claim 1, wherein said first and second rows of indicator pins are aligned at an angle relative to one another.

12. A count indicator to indicate first and second parameters and comprising:

a body sized to be held in a human hand;

a first row of indicators;

a second row of indicators;

each of said indicators from said first row of indicators having a first end and an opposite end and a first shape and being movable upwardly relative to said body to a first position in response to a first pushing force manually applied to said first end by a finger from the human hand in which said body is held and downwardly relative to said body to a second position in response to a second pushing force manually applied to said opposite end to provide an indication of the first parameter;

each of said indicators from said second row of indicators having a first end and an opposite end and a second shape and being movable upwardly relative to said body to said first position in response to a third pushing force manually applied to said first end by the same or a different finger of the human hand in which said body is held and downwardly relative to said body to said second position in response to a fourth pushing force manually applied to said opposite end to provide an indication of the second parameter; and the first shape of each of said indicators from said first row thereof being tactilely distinguishable from the second shape of each of said indicators from said second row thereof, whereby the indications of the first and second parameters are determinable by means of manually touching each of the indicators from said first and second rows of indicators and sensing the respective shapes and the first or second positions thereof relative to said body.

13. The count indicator recited in claim 12, wherein each of the indicators from at least the first row of indicators is an indicator pin.

14. The count indicator recited in claim 13, wherein each of said indicator pins from the first row of indicators is slidable through said body from said first position to said second position to provide the indication of one of said first or second parameters.

15. The count indicator recited in claim 14, wherein the body of said count indicator has a top and a bottom, and wherein each of said indicator pins from the first row of indicators is slidable through said body from said first position extending outwardly from the top of said body to said second position extending outwardly from the bottom of said body.

16. The count indicator recited in claim 15, wherein there is at least one row of holes formed through the body of said count indicator and extending between the top and the bottom of said body, the indicator pins from the first row of indicators being received within and slidable between said first and second positions through respective ones of the holes from said one row thereof.

17. The count indicator recited in claim 16, wherein there is a plurality of guide channels having opposing end walls formed through the body of said count indicator and communicating with respective ones of the holes from said one row of holes, and wherein each of the indicator pins from said first row of indicators has a stop projecting therefrom and riding through a corresponding one of said plurality of guide channels for receipt against an end wall thereof so as to limit the travel of said first row of indicator pins and prevent said indicator pins from becoming separated from said body when said indicator pins move upwardly and downwardly relative to said body between said first and second positions.

18. The count indicator recited in claim 16, wherein there is a plurality of locking protrusions located between the top and the bottom of said body, and wherein each of the indicator pins from the first row of indicators has first and second locking detents formed therein and located one above the other, each of said locking protrusions from said plurality of locking protrusions being removably received within a respective one of said first or second locking detents from each of said indicator pins to hold said indicator pins at one of said first or second positions relative to the body of said count indicator.

19. The count indicator recited in claim 18, wherein each of said plurality of locking protrusions is a ball carried by a flexible locking arm having a spring memory, said flexible locking arm applying a pushing force against said ball to urge said ball into removable receipt by one of said first or second locking detents of a corresponding one of said indicator pins depending upon whether said indicator pin is located in said first position or said second position.

20. The count indicator recited in claim 18, wherein each of said plurality of locking protrusions is a spring-actuated ball nose plunger having a spring that communicates with a ball to apply a pushing force against said ball to urge said ball into removable receipt by one of said first or second locking detents of a corresponding one of said indicator pins depending upon whether said indicator pin is in said first position or said second position.

* * * * *